US008692726B2

(12) United States Patent
Mukai et al.

(10) Patent No.: US 8,692,726 B2
(45) Date of Patent: Apr. 8, 2014

(54) GLASS ANTENNA FOR VEHICLE

(75) Inventors: Hiroshi Mukai, Matsusaka (JP); Masanori Kaihatsu, Matsusaka (JP)

(73) Assignee: Central Glass Company Limited., Ube-shi (JP)

( * ) Notice: Subject to any disclaimer, the term of this patent is extended or adjusted under 35 U.S.C. 154(b) by 325 days.

(21) Appl. No.: 12/989,317

(22) PCT Filed: Jul. 21, 2009

(86) PCT No.: PCT/JP2009/063313

§ 371 (c)(1),
(2), (4) Date: Oct. 22, 2010

(87) PCT Pub. No.: WO2010/029815

PCT Pub. Date: Mar. 18, 2010

(65) Prior Publication Data

US 2011/0037668 A1 Feb. 17, 2011

(30) Foreign Application Priority Data

Sep. 12, 2008 (JP) ..... 2008-234494
Jul. 17, 2009 (JP) ..... 2009-168663

(51) Int. Cl.
*H01Q 1/32* (2006.01)

(52) U.S. Cl.
USPC ..... 343/712; 343/713; 343/711

(58) Field of Classification Search
USPC ..... 343/711, 712, 713
See application file for complete search history.

(56) References Cited

U.S. PATENT DOCUMENTS

| | | | | |
|---|---|---|---|---|
| 5,418,543 | A | 5/1995 | Bolton | |
| 5,499,034 | A | 3/1996 | Fujii et al. | |
| 5,657,029 | A | 8/1997 | Iijima et al. | |
| 6,057,803 | A * | 5/2000 | Kane et al. | 343/713 |
| 6,441,791 | B1 | 8/2002 | Oka | |
| 7,286,098 | B2 | 10/2007 | Ogino et al. | |

(Continued)

FOREIGN PATENT DOCUMENTS

| | | |
|---|---|---|
| DE | 10331213 A1 | 2/2005 |
| EP | 0411963 A2 | 2/1991 |

(Continued)

OTHER PUBLICATIONS

International Search Report of PCT/JP2009/063313, mailing date Nov. 2, 2009.

(Continued)

*Primary Examiner* — Dieu H Duong
(74) *Attorney, Agent, or Firm* — Westerman, Hattori, Daniels & Adrian, LLP

(57) ABSTRACT

To provide a sensitive antenna with simple pattern, there is provided an antenna comprising: a core-side element connected to a core-side feed point; and a ground-side element connected to a ground-side feed point, wherein: the core-side element extends from the core-side feed point in a predetermined direction; the ground-side element includes: a first element which is connected to the ground-side feed point and extends in parallel to the core-side element; and a second element which is connected to the ground-side feed point and extends in parallel to the first element; and the first element is located close to a body flange to capacitively couple with the body flange.

14 Claims, 10 Drawing Sheets

(56) References Cited

U.S. PATENT DOCUMENTS

| | | | | |
|---|---|---|---|---|
| 2004/0164913 | A1* | 8/2004 | Ogino | 343/713 |
| 2005/0024279 | A1 | 2/2005 | Kuehne | |
| 2005/0030235 | A1* | 2/2005 | Noguchi et al. | 343/713 |
| 2005/0052334 | A1 | 3/2005 | Ogino et al. | |
| 2005/0140555 | A1* | 6/2005 | Fujii et al. | 343/704 |
| 2005/0156798 | A1* | 7/2005 | Bally et al. | 343/713 |
| 2006/0077109 | A1* | 4/2006 | Baba et al. | 343/704 |
| 2007/0063906 | A1* | 3/2007 | Langley | 343/713 |
| 2007/0247379 | A1* | 10/2007 | Oshima et al. | 343/713 |

FOREIGN PATENT DOCUMENTS

| | | | |
|---|---|---|---|
| JP | 6-053723 | A | 2/1994 |
| JP | 6-276008 | A | 9/1994 |
| JP | 6-314921 | A | 11/1994 |
| JP | 11-122018 | A | 4/1999 |
| JP | 2000-216613 | A | 4/2000 |
| JP | 2001-156520 | A | 6/2001 |
| JP | 2004-507192 | A | 3/2004 |
| JP | 2005-236656 | A | 9/2005 |
| JP | 2005-354139 | A | 12/2005 |
| JP | 2007-150966 | A | 6/2007 |
| JP | 2008-124822 | A | 5/2008 |
| JP | 2008-135944 | A | 6/2008 |
| JP | 2008-172626 | A | 7/2008 |

OTHER PUBLICATIONS

Supplementary European Search Report dated Sep. 22, 2011, issued in corresponding European Patent Application No. 09812963.8.

Chinese Office Action dated Aug. 29, 2013, issued in corresponding Chinese Application No. 200980122704.3. (8 pages).

* cited by examiner

GLASS ANTENNA FOR VEHICLE

BACKGROUND OF THE INVENTION

This invention relates to an antenna, and, in particular, relates to a glass antenna which is to be mounted on a vehicle window glass and is suitable for receiving digital terrestrial TV broadcast signals and UHF analog TV broadcast signals.

For vehicle glass antennas, antennas to be mounted in the spaces upper or lower than heating conductive lines of defogger on rear window glasses have been developed and widely known so far (for example, refer to JP 2008-124822 A, JP 2005-354139 A, JP 2008-135944 A, and JP 2007-150966 A). To mount such an antenna on a rear window glass, the space for mounting the antenna is limited because defogging heating lines are arranged over most of the area of the rear window glass.

Besides, to improve the antenna sensitivity of a rear window glass antenna, the number of elements is increased or vertical elements are added within the defogger area. Accordingly, the antenna pattern has been more complex, so good looks and the field of view can not be achieved. In addition, the increase in the number of element lines has caused a problem of increase in time and costs for tuning development.

If an antenna is mounted on a front window glass to improve its receiving performance, a simpler antenna pattern and a more compact size are required for the antenna to ensure a wider field of view through the front window glass.

All of the antennas in the above-referenced patent documents are large-sized antennas to be mounted on rear window glasses and are not compact antennas particularly intended to be mounted on front window glasses, for which drivers' field of view is considered to be more important. Accordingly, a more compact and simpler antenna is desired that is to be mounted on a front window glass and does not interfere with the driver's field of view.

An object of this invention is to provide an antenna with simple pattern which ensures required sensitivity and can be arranged on a front window glass.

SUMMARY OF THE INVENTION

An aspect of this invention is an antenna comprising: a core-side element connected to a core-side feed point; and a ground-side element connected to a ground-side feed point, wherein: the core-side element extends from the core-side feed point in a predetermined direction; the ground-side element includes: a first element which is connected to the ground-side feed point and extends in parallel to the core-side element; and a second element which is connected to the ground-side feed point and extends in parallel to the first element; and the first element is located close to a body flange to capacitively couple with the body flange.

In another aspect, the core-side element includes at least one line extending from the core-side feed point in a horizontal direction.

In another aspect, the first element extends in parallel to the core-side element via a conductive part extending from the ground-side feed point in a first vertical direction; and the second element extends in parallel to the first element via a conductive part extending from the ground-side feed point in a second vertical direction opposite from the first vertical direction.

In another aspect, the first element and the second element extend in the direction in which the core-side element extends.

In another aspect, at least one of the first element and the second element includes an auxiliary element which extends in a direction opposite from the direction in which the first element and the second element extend.

In another aspect, a diversity antenna comprises a pair of the above described antennas placed side by side.

In another aspect, at least a part of the elements, the conductive parts, and the feed points of the antenna are arranged on a ceramic paste layer provided on an interior surface of a rim of a window glass; at least a part of the elements, the conductive parts, and the feed terminals are masked with a resin cover.

The antenna of this invention achieves a simpler antenna pattern and ensures required antenna sensitivity by an arrangement in which one element line of a ground-side element is arranged close to the body flange while another element line of the ground-side element is arranged on the opposite side. Accordingly, a compact and high-performance antenna can be provided that will not be a disturbance to the driver's field of view even if the antenna is mounted on the front window glass.

Furthermore, one element line of the ground-side element is arranged close to the body flange and the other element line of the ground-side element is arranged on the opposite side. so easy tuning of the antenna characteristics is achieved and the development period is shortened.

Furthermore, at least a part of antenna elements, conductive parts, and feed terminals is arranged on ceramic paste, so the antenna is hardly seen from the outside of the vehicle, providing good looks. Besides, at least a part of the antenna elements, the conductive parts, and the feed terminals are covered with the vehicle interior material made of resin, providing good looks from the inside of the vehicle likewise.

DETAILED DESCRIPTION OF THE EMBODIMENTS

Hereinafter, vehicle glass antennas according to preferred embodiments of this invention will be described.

First Embodiment

Figure 1:
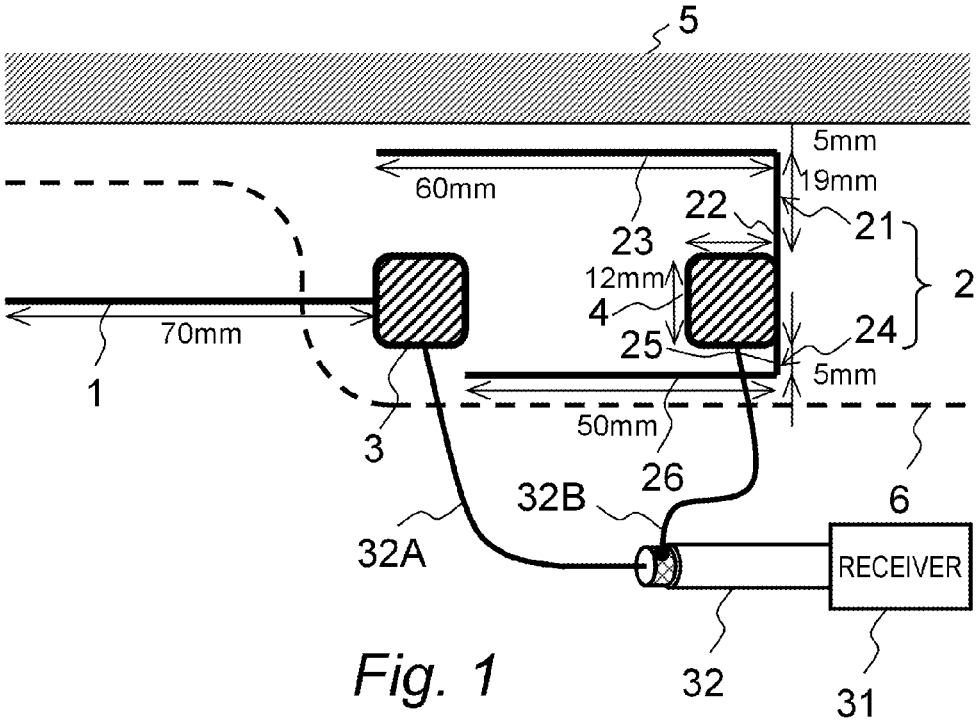
FIG. 1 is an explanatory diagram illustrating a configuration of a glass antenna according to a first embodiment of this invention.

FIG. 1 illustrates a configuration of a glass antenna according to a first embodiment of this invention.

The glass antenna according to the embodiments of this invention comprises a core-side element 1 and a ground-side element 2. The core-side element 1 is connected to a feed terminal 3 and the ground-side element 2 is connected to a feed terminal 4. The feed terminals 3 and 4 are connected to a receiver 31 (for example, a television set) via feeder cables 32A and 32B.

The ground-side element 2 comprises a first element 21 connected to an upper part of the feed terminal 4 and a second element 24 connected to a lower part thereof.

The first element 21 extends upward from the right end of the feed terminal 4 to form a vertical part 22. It should be noted that the vertical part 22 may extend from the left end or the middle of the feed terminal 4 as in the tenth and eleventh embodiments, which will be described later.

The end of the vertical part 22 bends in the direction of the feed terminal 3 (leftward) and extends to the proximity of the feed terminal 3 to form a horizontal part 23. The horizontal part 23 lies close to the body flange 5 of the vehicle on which this antenna is mounted; the first element 21 capacitively couples with the body flange 5 (the ground). In particular, the horizontal part 23 is arranged in parallel to the body flange, so that the entirety of the horizontal part 23 capacitively couples with the body flange.

The second element 24 extends downward from the right end of the feed terminal 4 to form a vertical part 25. It should be noted that the vertical part 25 may extend from the left end or the middle of the feed terminal 4. Then, the end of the vertical part 25 bends in the direction of the feed terminal 3 (leftward) and extends to the proximity of the feed terminal 3 to form a horizontal part 26.

Through such an arrangement of the elements, the first element 21 and the second element 24 are arranged opposite from each other sandwiching the core-side feed terminal therebetween.

Although the horizontal part 23 of the first element 21 and the horizontal part 26 of the second element 24 extend in the direction of the feed terminal 3 (leftward), they may extend in the direction opposite from the feed terminal 3, wherein the strength of the coupling between the first element 21 and the body flange changes in accordance with the current distribution in the body flange 5. However, it is preferable that the horizontal part 23 and the horizontal part 26 extend in the direction of the feed terminal 3 (leftward) because the antenna can be made compact in size.

As for the antenna according to the first embodiment, the feed terminals 3 and 4, the core-side element 1, and the ground-side element 2 are formed by printing and stoving conductive silver paste on a ceramic paste layer 6 provided on the inner surface of a vehicle window glass. The end of the ceramic paste layer 6 is denoted by a dashed line. The ceramic paste layer 6 is usually a black and belt-shaped insulating layer formed by stoving screen-printed ceramic paste on the glass. The ceramic paste is a paste made of low-melting glass powder and pigments.

The antenna arranged on the ceramic paste layer in the above-described manner provides better looks because the antenna and the feed terminals are covered with the black ceramic paste so that they are invisible from the outside of the vehicle.

In FIG. 1, a part of the core-wire element 1 and the whole ground-side element 2 are arranged on the ceramic paste layer 6. However, a part of the core-wire element 1 and a part of the ground-side element 2 may be arranged on the ceramic paste layer 6; the whole core-wire element 1 and the whole ground-side element 2 may be arranged on the ceramic paste layer 6; or the whole core-wire element 1 and a part of the ground-side element 2 may be arranged on the ceramic paste layer 6.

It is preferable that the antenna according to the first embodiment comprise a cover for masking the core-side element 1 and the ground-side element 2. Preferably, the cover is made of a vehicular interior material, which is resin, and masks a part or the entirety of the core-side element 1 and the ground-side element 2. Since the cover makes the feed terminals 3 and 4 and the elements invisible from the inside of the vehicle, the looks from the inside of the vehicle improves. In particular, the feed terminals 3 and 4 and the coaxial cable 32 connecting to the feed terminals are noticeable; it is preferable that at least the feed terminals and the cables 32A, 32B and 32 are masked with the cover.

The workings of the glass antenna according to this embodiment will now be discussed.

The antenna according to this embodiment is an ungrounded antenna whose ground-side element 2 is not actually grounded. However, the first element 21 capacitively couples with the body flange. Accordingly, the electric potential of the first element 21 is close to the ground level. Therefore, the antenna according to this embodiment may be considered as a monopole antenna which comprises a ground-side element 2 for the ground and a core-side element 1 for a radiating element.

In the meanwhile, the second element 24 may be considered to function as a radiating element. In this case, the ground-side element 2 functions as a radiating element on the ground side, which is opposed to the core-side element 1.

Therefore, the antenna according to this embodiment may be considered as a dipole antenna.

In view of the aboves, the antenna according to this embodiment may be considered to have characteristics of a monopole antenna and characteristics of a dipole antenna together. Therefore, as will be described later, the antenna characteristics change in different ways depending on whether the length of the first element 21 is changed or the length of the second element 24 is changed.

To provide such characteristics to the first element 21 and the second element 24, it is necessary that the first element 21 be strongly coupled with the body flange. On the other hand, the second element 24 does not need to be coupled with the feed terminal 3 or does not need to be coupled so strong, depending on the length of the second element 24.

Figure 10:
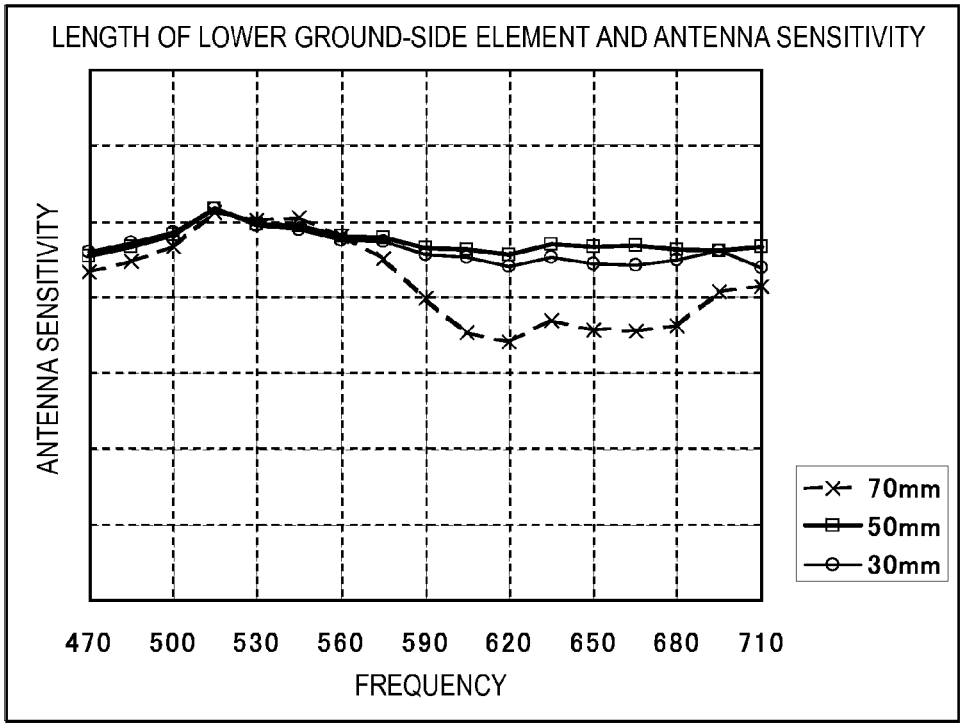
FIG. 10 is an explanatory diagram illustrating a characteristics of the glass antenna according to the first embodiment of this invention.

The horizontal part 26 of the second element 24 is shorter than the horizontal part 23 of the first element 21 and is shorter than the core-side element 1. Therefore, focusing on the function of the ground-side element 2 as a radiating element, the ground-side element 2 (for example, the length of the horizontal part 26) affects the characteristics (for example, sensitivity) at high frequencies. For example, as shown in FIG. 10, the characteristics at low frequencies change little as the length of the horizontal part 26 of the second element 24 is changed from 30 mm to 50 mm, and further to 70 mm, but the characteristics at higher frequencies change considerably.

In other words, since the ground-side element 2 is configured to be separated into a part which is closely coupled with the body flange and a part which is not coupled with the body flange, the changes in antenna characteristics differ depending on the structure of the part (the length, the shape of the element, the number of elements, and the like) so that the antenna characteristics can be tuned easily.

The antenna according to the first embodiment in FIG. 1 is to be arranged along the top rim of the vehicle window glass, so the first element 21 is provided in parallel to the body flange. However, the antenna may be arranged along the bottom rim of the window glass. In such a case, the second element 24 is arranged in parallel to the body flange to capacitively couple with the body flange.

It is preferable that the antenna according to this embodiment be arranged along the upper rim of a vehicle front window glass. However, it may be arranged along the top rim of a rear window glass or a side window glass. Moreover, if it receives vertically polarized signals, it may be arranged along a side rim of a front window glass, a rear window glass or a side window glass.

Either one or both of the vertical parts 22 and 25 are not necessarily provided. For example, as will be described later in the seventh and the eighth embodiments, either one or both of the vertical parts 22 and 25 do not need to be provided.

FIG. 1 also includes examples of the dimensions when the first embodiment has been applied to an antenna for the UHF television band in Japan (470 to 770 MHz). It is preferable that the length of the core-side element 1 be the value obtained by multiplying ¼ of the wavelength corresponding to a frequency (620 MHz) close to the central frequency of the antenna by the wavelength shortening rate $\alpha$. The dimensions shown in FIG. 1 are for an example of the glass antenna according to the first embodiment but are not for limiting this embodiment.

Hereinafter, modified examples of this invention will be described. In the following modified examples, the constituents same as in the above-described first embodiment are denoted by the same reference signs and the descriptions thereon will be omitted.

Second Embodiment

Figure 2:
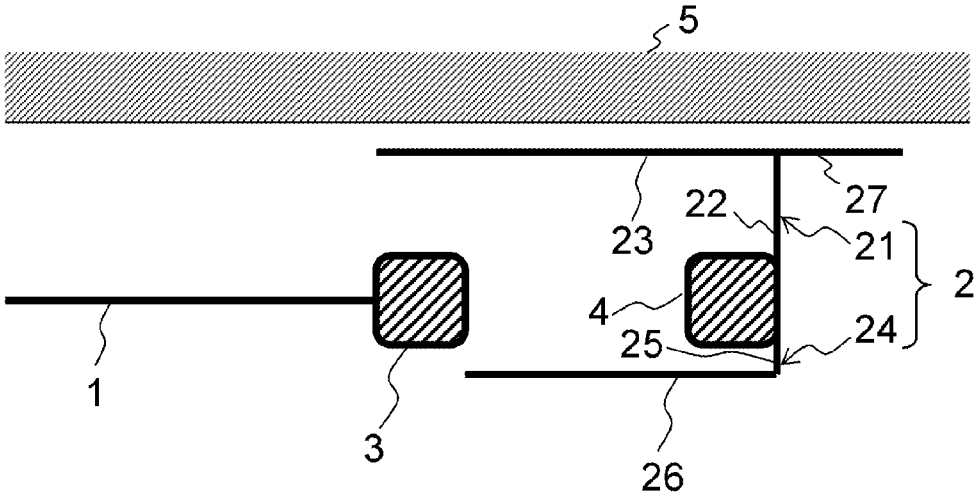
FIG. 2 is an explanatory diagram illustrating a configuration of a glass antenna according to a second embodiment of this invention.

FIG. 2 illustrates a configuration of a glass antenna according to a second embodiment of this invention.

The glass antenna according to the second embodiment is an antenna with a horizontal part (an auxiliary element) 27 added to the ground-side element 2 of the above-described glass antenna according to the first embodiment.

The glass antenna according to the second embodiment comprises a core-side element 1 on the feed side and a ground-side element 2. The core-side element 1 is connected to a feed terminal 3. The ground-side element 2 comprises a first element 21 connected to an upper part of a feed terminal 4 and a second element 24 connected to a lower part thereof. A horizontal part 26 of the second element 24 extends to the proximity of the feed terminal 3.

The first element 21 extends upward from the feed terminal 4 to form a vertical part 22. Then, the end of the vertical part 22 bends in the direction of the feed terminal 3 (leftward) and extends to the proximity of the feed terminal 3 to form a horizontal part 23. The first element 21 bifurcates at the end of the vertical part 22 and extends in the direction opposite from the feed terminal 3 (rightward) to form the horizontal part 27.

The horizontal part 23 and the horizontal part 27 are close to the body flange 5 of the vehicle on which this antenna is to be mounted, so the first element 21 capacitively couples with the body flange 5 (the ground). In particular, the horizontal part 23 and the horizontal part 27 are arranged in parallel to the body flange, so that the entirety of the horizontal part 23 and the horizontal part 27 capacitively couples with the body flange.

Although the horizontal part 27 has a shorter length than the horizontal part 23 in the antenna shown in FIG. 2, the horizontal part 27 may have the same length as the horizontal part 23 or a longer length than the horizontal part 23.

According to the antenna of the second embodiment, the whole length of the horizontal part including the horizontal part 23 can be changed by adjusting the length of the horizontal part 27. Accordingly, the strength in the capacitive coupling between the first element 21 and the body flange can be changed, so that the resonant frequency of the antenna can be changed easily.

Third Embodiment

Figure 3:
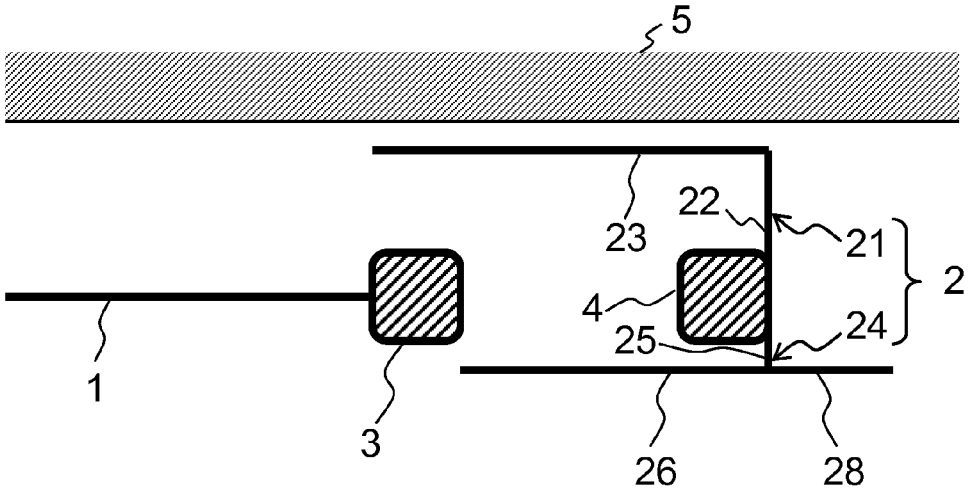
FIG. 3 is an explanatory diagram illustrating a configuration of a glass antenna according to a third embodiment of this invention.

FIG. 3 illustrates a configuration of a glass antenna according to a third embodiment of this invention.

The glass antenna according to the third embodiment is an antenna with a horizontal part (an auxiliary element) 28 added to the ground-side element 2 of the above-described glass antenna according to the first embodiment.

The glass antenna according to the third embodiment comprises a core-side element 1 on the feed side and a ground-side element 2. The core-side element 1 is connected to a feed terminal 3. The ground-side element 2 comprises a first element 21 connected to an upper part of a feed terminal 4 and a second element 24 connected to a lower part thereof. The entirety of a horizontal part 23 of the first element 21 is configured to capacitively couple with the body flange.

The second element 24 extends downward from the feed terminal 4 to form a vertical part 25. Then, the end of the vertical part 25 bends in the direction of the feed terminal 3 (leftward) and extends to the proximity of the feed terminal 3 to form a horizontal part 26. The second element 24 bifurcates at the end of the vertical part 25 and extends in the direction opposite from the feed terminal 3 (rightward) to form the horizontal part 28.

Although the horizontal part 28 has a shorter length than the horizontal part 26 in the antenna shown in FIG. 3, the horizontal part 28 may have the same length as the horizontal part 26 or a longer length than the horizontal part 26.

According to the antenna of the third embodiment, the whole length of the horizontal part including the horizontal part 26 can be changed by adjusting the length of the horizontal part 28. Accordingly, the antenna characteristics at high frequencies can be changed easily.

Fourth Embodiment

Figure 4:
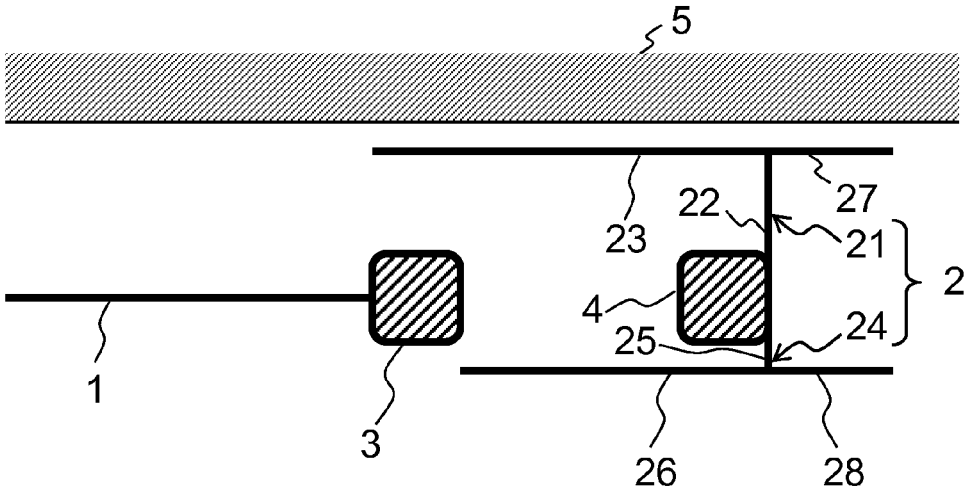
FIG. 4 is an explanatory diagram illustrating a configuration of a glass antenna according to a fourth embodiment of this invention.

FIG. 4 illustrates a configuration of a glass antenna according to a fourth embodiment of this invention.

The glass antenna according to the fourth embodiment is an antenna with a horizontal part (an auxiliary element) 27 added to the first element 21 on the ground side of the above-described glass antenna according to the first embodiment, as well as a horizontal part (an auxiliary element) 28 added to the second element 24 on the ground side thereof.

The glass antenna according to the fourth embodiment comprises a core-side element 1 on the feed side and a ground-side element 2. The core-side element 1 is connected to a feed terminal 3. The ground-side element 2 comprises a first element 21 connected to an upper part of a feed terminal 4 and a second element 24 connected to a lower part thereof.

The first element 21 extends upward from the feed terminal 4 to form a vertical part 22. Then, the end of the vertical part 22 bends in the direction of the feed terminal 3 (leftward) and extends to the proximity of the feed terminal 3 to form a horizontal part 23. The first element 21 bifurcates at the end of the vertical part 22 and extends in the direction opposite from the feed terminal 3 (rightward) to form the horizontal part 27.

The horizontal part 23 and the horizontal part 27 are close to the body flange 5 of the vehicle on which this antenna is to be mounted, so the first element 21 capacitively couples with the body flange 5 (the ground). In particular, the horizontal part 23 and the horizontal part 27 are arranged in parallel to the body flange, so that the entirety of the horizontal part 23 and the horizontal part 27 capacitively couples with the body flange.

The second element 24 extends downward from the feed terminal 4 to form a vertical part 25. Then, the end of the vertical part 25 bends in the direction of the feed terminal 3 (leftward) and extends to the proximity of the feed terminal 3 to form a horizontal part 26. The second element 24 bifurcates at the end of the vertical part 25 and extends in the direction opposite from the feed terminal 3 (rightward) to form the horizontal part 28.

Although the horizontal part 27 has a shorter length than the horizontal part 23 in the antenna shown in FIG. 4, the horizontal part 27 may have the same length as the horizontal part 23 or a longer length than the horizontal part 23. Similarly, although the horizontal part 28 has a shorter length than the horizontal part 26, the horizontal part 28 may have the same length as the horizontal part 26 or a longer length than the horizontal part 26.

According to the antenna of the fourth embodiment, the whole length of the horizontal part of the first element 21 including the horizontal part 23 can be changed by adjusting the length of the horizontal part 27. Accordingly, the strength in the capacitive coupling between the first element 21 and the body flange can be changed, so that the resonant frequency of the antenna can be changed. In addition, the whole length of the horizontal part of the second element 24 including the horizontal part 26 can be changed by adjusting the length of the horizontal part 28. Accordingly, the antenna characteristics at high frequencies can be changed easily.

Fifth Embodiment

Figure 5:
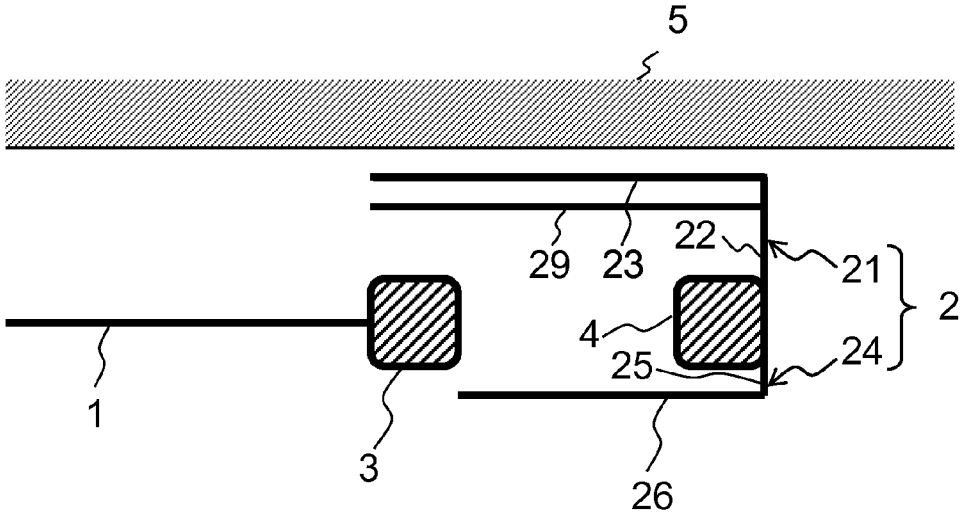
FIG. 5 is an explanatory diagram illustrating a configuration of a glass antenna according to a fifth embodiment of this invention.

FIG. 5 illustrates a configuration of a glass antenna according to a fifth embodiment of this invention.

The glass antenna according to the fifth embodiment is an antenna with a plurality of horizontal parts of the first element of the above-described glass antenna according to the first embodiment.

The glass antenna according to the fifth embodiment comprises a core-side element 1 on the feed side and a ground-side element 2. The core-side element 1 is connected to a feed terminal 3. The ground-side element 2 comprises a first element 21 connected to an upper part of a feed terminal 4 and a second element 24 connected to a lower part thereof. A horizontal part 26 of the second element 24 extends to the proximity of the feed terminal 3.

The first element 21 extends upward from the feed terminal 4 to form a vertical part 22. Then, the end of the vertical part 22 bends in the direction of the feed terminal 3 (leftward) and extends to the proximity of the feed terminal 3 to form a horizontal part 23. The first element 21 bifurcates at the middle of the vertical part 22 and extends in the direction of the feed terminal 3 (leftward) to form a horizontal part 29, which is parallel to the horizontal part 23.

The horizontal part 23 is close to the body flange 5 of the vehicle on which this antenna is to be mounted, so the first element 21 capacitively couples with the body flange 5 (the ground). In particular, the horizontal part 23 is arranged in parallel to the body flange and the horizontal part 29 is arranged in parallel to the horizontal part 23, so that the entirety of the horizontal part 23 and the horizontal part 29 capacitively couples with the body flange. In other words, the horizontal part 29 capacitively couples with the body flange via the horizontal part 23.

According to the antenna of the fifth embodiment, the strength in the capacitive coupling between the first element 21 and the body flange can be changed by adjusting the lengths of the horizontal parts 23 and 29, so that the resonant frequency of the antenna can be changed.

It should be noted that the horizontal part 23 and/or the horizontal part 26 may extend rightward applying any one of the second to the fourth embodiments to the antenna according to the fifth embodiment.

Sixth Embodiment

Figure 6:
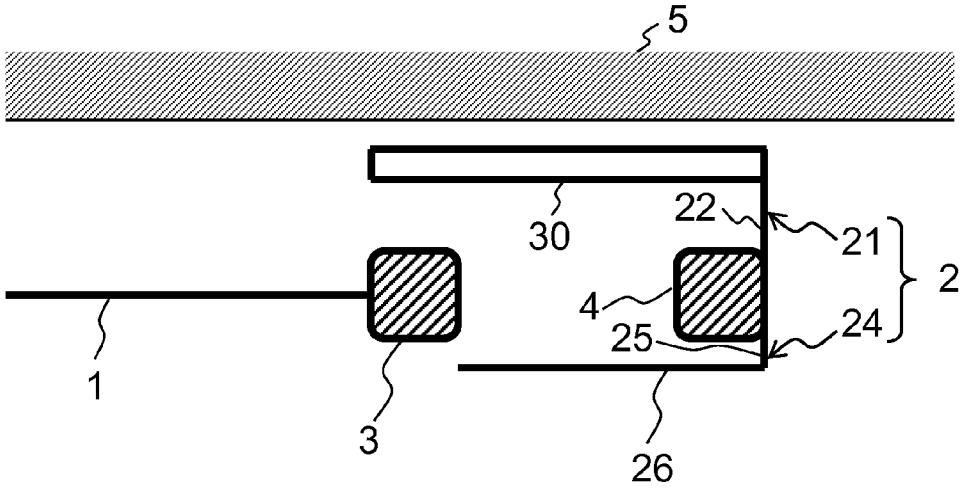
FIG. 6 is an explanatory diagram illustrating a configuration of a glass antenna according to a sixth embodiment of this invention.

FIG. 6 illustrates a configuration of a glass antenna according to a sixth embodiment of this invention.

In the glass antenna according to the sixth embodiment, the horizontal part of the first element 21 in the above-described glass antenna according to the first embodiment is loop-shaped.

The glass antenna according to the sixth embodiment comprises a core-side element 1 on the feed side and a ground-side element 2. The core-side element 1 is connected to a feed terminal 3. The ground-side element 2 comprises a first element 21 connected to an upper part of a feed terminal 4 and a second element 24 connected to a lower part thereof. A horizontal part 26 of the second element 24 extends to the proximity of the feed terminal 3.

The first element 21 extends upward from the feed terminal 4 to form a vertical part 22. Furthermore, the first element 21 includes a loop conductor 30 at the end of the vertical part 22. The end of the loop conductor 30 extends to the proximity of the feed terminal 3.

The loop conductor 30 is close to the body flange 5 of the vehicle on which this antenna is to be mounted, so the first element 21 capacitively couples with the body flange 5 (the ground). In particular, the upper line of the loop conductor 30 is arranged in parallel to the body flange, so that the whole upper line of the loop conductor 30 capacitively couples with the body flange.

Since the antenna according to the sixth embodiment is equipped with the loop conductor 30 at the end of the first element 21, the band for the antenna can be broadened, and additionally, the resonant frequency of the antenna can be changed easily.

It should be noted that, the horizontal part 26 may extend rightward applying the third embodiment to the antenna according to the sixth embodiment.

Seventh Embodiment

Figure 7:
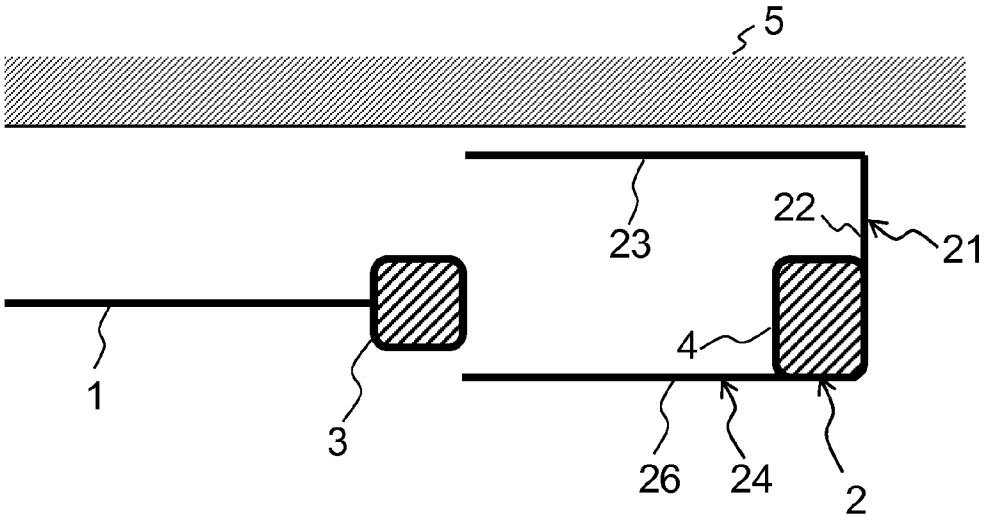
FIG. 7 is an explanatory diagram illustrating a configuration of a glass antenna according to a seventh embodiment of this invention.

FIG. 7 illustrates a configuration of a glass antenna according to a seventh embodiment of this invention.

The glass antenna according to the seventh embodiment is an antenna which does not have the vertical part 25 in the above-described glass antenna according to the first embodiment.

The glass antenna according to the seventh embodiment comprises a core-side element 1 on the feed side and a ground-side element 2. The core-side element 1 is connected to a feed terminal 3. The ground-side element 2 comprises a first element 21 connected to an upper part of a feed terminal 4 and a second element 24 connected to a lower part thereof.

The horizontal part 23 of the first element 21 is connected to the feed terminal 4 via a vertical part 22. The entirety of the horizontal part 23 is configured to capacitively couple with the body flange 5. The second element 24 extends in the direction of the feed terminal 3 (leftward) horizontally from the feed terminal 4 to the proximity of the feed terminal 3 to form a horizontal part 26.

According to the antenna of the seventh embodiment, like in the above-described first embodiment, the resonant frequency of the antenna changes depending on the length of the first element 21 and the sensitivity at high frequencies changes depending on the length of the second element 24. Accordingly, the antenna characteristics can be tuned easily.

Although the configuration without a vertical part 25 has been described as the seventh embodiment, the seventh embodiment includes a configuration in which the feed terminal 4 is located on the upper side while a vertical part 25 is provided and the vertical part 22 is not provided.

Eighth Embodiment

Figure 8:
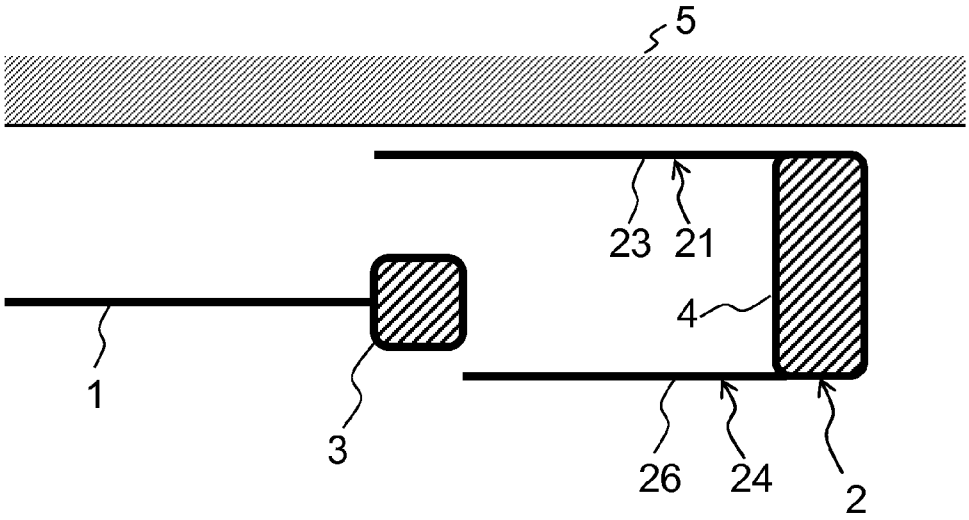
FIG. 8 is an explanatory diagram illustrating a configuration of a glass antenna according to an eighth embodiment of this invention.

FIG. 8 illustrates a configuration of a glass antenna according to an eighth embodiment of this invention.

The glass antenna according to the eighth embodiment is an antenna which has neither the vertical part 22 nor the vertical part 25 in the above-described glass antenna according to the first embodiment.

The glass antenna according to the eighth embodiment comprises a core-side element 1 on the feed side and a ground-side element 2. The core-side element 1 is connected to a feed terminal 3. The ground-side element 2 comprises a first element 21 connected to an upper part of a feed terminal 4 and a second element 24 connected to a lower part thereof.

The first element 21 extends from the feed terminal 4 in the direction of the feed terminal 3 (leftward) to form a horizontal part 23. The entirety of the horizontal part 23 is configured to capacitively couple with the body flange. The second element 24 extends from the feed terminal 4 to the proximity of the feed terminal 3 in the direction of the feed terminal 3 (leftward) to form a horizontal part 26.

According to the antenna of the eighth embodiment, like in the above-described first embodiment, the resonant frequency of the antenna changes depending on the length of the first element 21 and the sensitivity at high frequencies changes depending on the length of the second element 24. Accordingly the antenna characteristics can be tuned easily.

Antenna Characteristics

Figure 9:
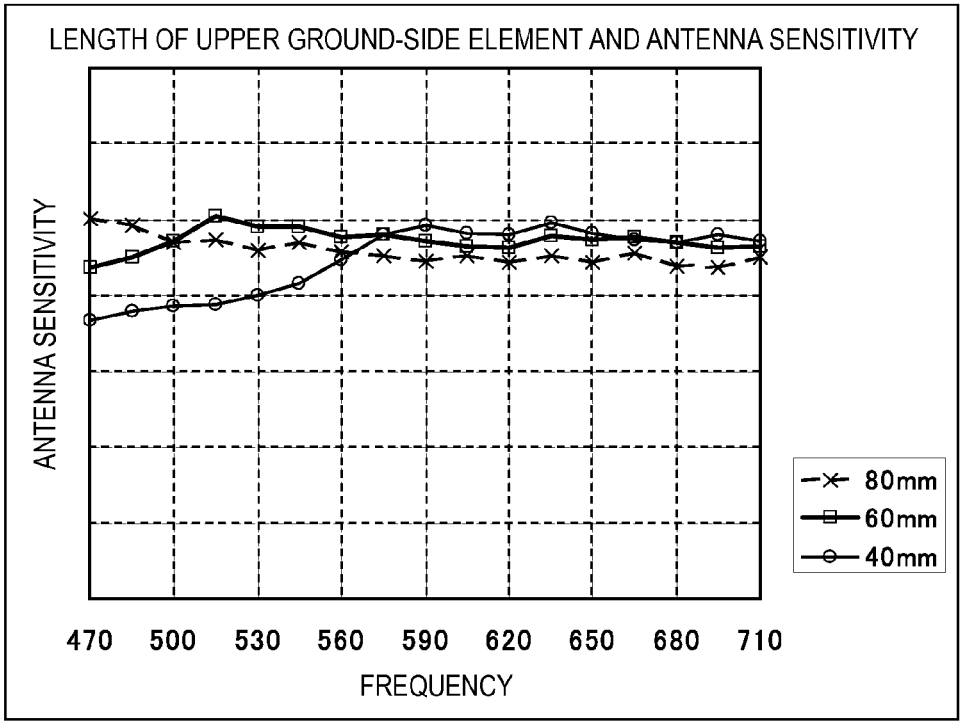
FIG. 9 is an explanatory diagram illustrating a characteristics of the glass antenna according to the first embodiment of this invention.

FIG. 9 illustrates the antenna characteristics of the glass antenna according to the first embodiment of this invention.

FIG. 9 shows changes in antenna sensitivity when the length of the horizontal part 23 of the first element 21 is changed from 40 mm to 60 mm, and further to 80 mm. As seen from FIG. 9, the longer the horizontal part 23, the lower the resonant frequency of the antenna. In this situation, other characteristics including the sensitivity at higher frequencies show little change.

The resonant frequency can be changed in the same manner as in the characteristics graph of FIG. 9 by changing the length of the horizontal part 27 in the second or the fourth embodiment.

FIG. 10 illustrates the antenna characteristics of the glass antenna according to the first embodiment of this invention.

FIG. 10 shows changes in antenna sensitivity when the length of the horizontal part 24 of the second element 24 is changed from 30 mm to 50 mm, and further to 70 mm. As seen from FIG. 10, the longer the horizontal part 26, the lower the sensitivity at high frequencies (particularly, at higher than 570 MHz). In this situation, other characteristics including the sensitivity at lower frequencies show little change.

The sensitivity at high frequencies can be changed in the same manner as in the characteristics graph of FIG. 10 by changing the length of the horizontal part 28 in the third or the fourth embodiment.

Ninth Embodiment

Figure 11:
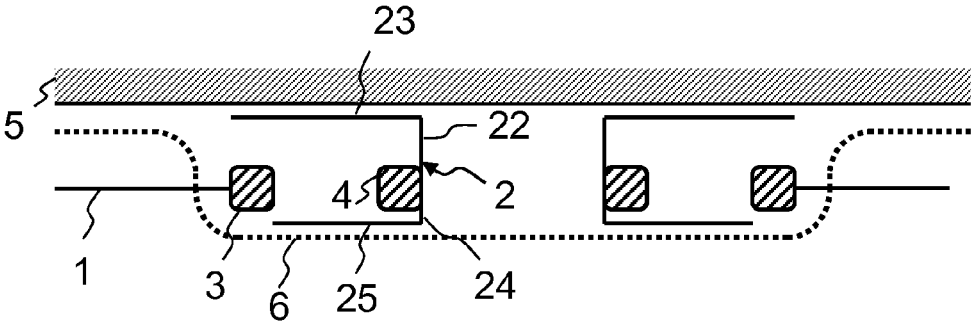
FIG. 11 is an explanatory diagram illustrating a configuration of a glass antenna according to a ninth embodiment of this invention.

FIG. 11 illustrates a configuration of a glass antenna according to a ninth embodiment of this invention.

The glass antenna according to the ninth embodiment is a diversity antenna comprised of two glass antennas according to the first embodiment arranged line symmetrically in such a manner that the ground-side elements 2 are opposed to each other. The reason why the ground-side elements 2 are arranged oppositely to each other is that the distance between the core-side elements 1 on the radiant side is wider to improve the diversity characteristics. For the diversity antenna according to the ninth embodiment, it is preferable to place the antennas more than ¼ of the wavelength away from each other.

Although FIG. 11 illustrates a diversity antenna using the antennas according to the first embodiment, the diversity antenna may be composed of the antennas according to any of the second to the fifteenth embodiments.

Tenth Embodiment

Figure 13:
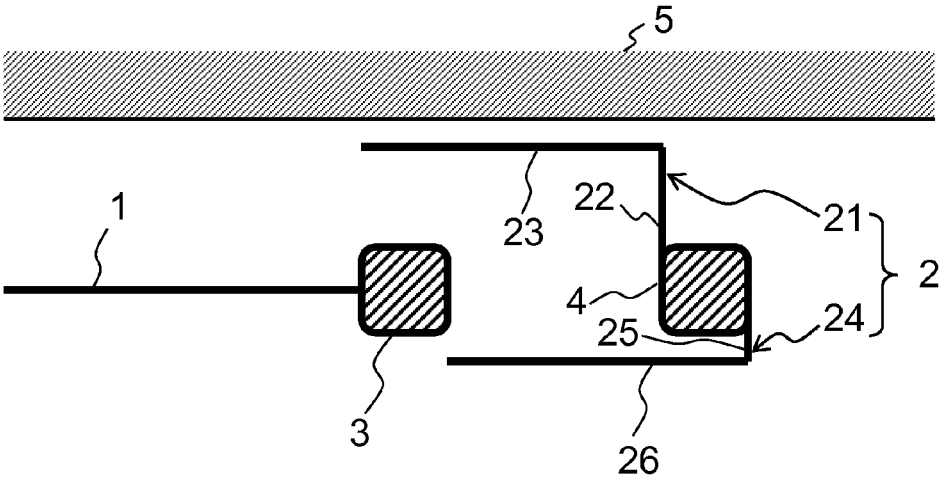
FIG. 13 is an explanatory diagram illustrating a configuration of a glass antenna according to a tenth embodiment of this invention.

FIG. 13 illustrates a configuration of a glass antenna according to a tenth embodiment of this invention.

In the glass antenna according to the tenth embodiment, the vertical part 22 of the above-described antenna according to the first embodiment extends upward from the left end of a feed terminal 4.

The glass antenna according to the tenth embodiment comprises a core-side element 1 on the feed side and a ground-side element 2. The core-side element 1 is connected to a feed terminal 3. The ground-side element 2 comprises a first element 21 connected to an upper part of the feed terminal 4 and a second element 24 connected to a lower part thereof.

The first element 21 comprises a vertical part 22 and a horizontal part 23. The horizontal part 23 is connected to the feed terminal 4 via a vertical part 22, which extends upward from the left end of the feed terminal 4, and extends from the connection point with the vertical part 22 in the direction of the feed terminal 3 (leftward). The entirety of the first element 21 is configured to capacitively couple with the body flange.

The second element 24 comprises a vertical part 25 and a horizontal part 26. The horizontal part 26 is connected to the feed terminal 4 via a vertical part 25, which extends downward from the right end of the feed terminal 4, and extends horizontally from the connection point with the vertical part 25 to the proximity of the feed terminal 3 in the direction of the feed terminal 3 (leftward).

According to the antenna of the tenth embodiment, like in the above-described first embodiment, the resonant frequency of the antenna changes depending on the length of the first element 21 and the sensitivity at high frequencies changes depending on the length of the second element 24, so the antenna characteristics can be tuned easily.

Eleventh Embodiment

Figure 14:
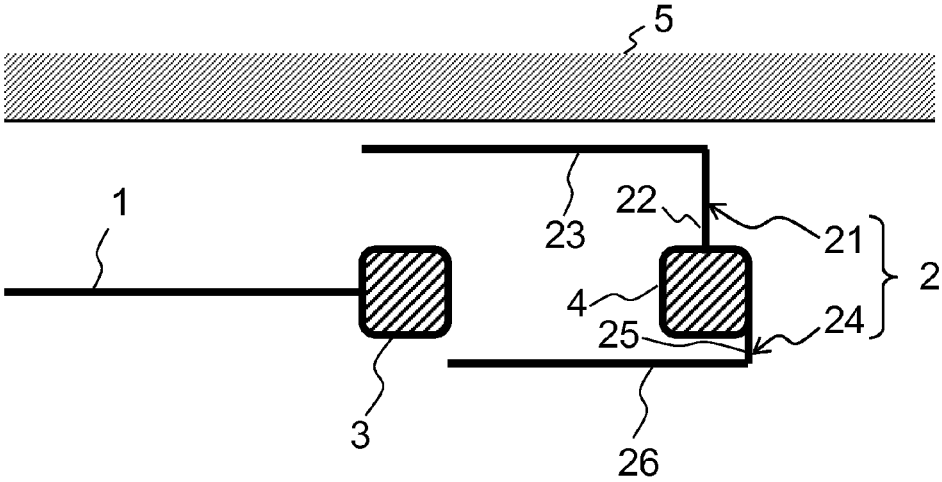
FIG. 14 is an explanatory diagram illustrating a configuration of a glass antenna according to an eleventh embodiment of this invention.

FIG. 14 illustrates a configuration of a glass antenna according to an eleventh embodiment of this invention.

In the glass antenna according to the eleventh embodiment, the vertical part 22 of the above-described antenna according to the first embodiment extends upward from the middle of a feed terminal 4.

The glass antenna according to the eleventh embodiment comprises a core-side element 1 on the feed side and a ground-side element 2. The core-side element 1 is connected to a feed terminal 3. The ground-side element 2 comprises a first element 21 connected to the upper part of the feed terminal 4 and a second element 24 connected to the lower part thereof.

The first element 21 comprises a vertical part 22 and a horizontal part 23. The horizontal part 23 is connected to the feed terminal 4 via a vertical part 22, which extends upward from the middle of the top end of the feed terminal 4, and extends from the connection point with the vertical part 22 in the direction of the feed terminal 3 (leftward). The entirety of the first element 21 is configured to capacitively couple with the body flange.

The second element 24 comprises a vertical part 25 and a horizontal part 26. The horizontal part 26 is connected to the feed terminal 4 via a vertical part 25, which extends downward from the right end of the feed terminal 4, and extends horizontally from the connection point with the vertical part 25 to the proximity of the feed terminal 3 in the direction of a feed terminal 3 (leftward).

According to the antenna of the eleventh embodiment, like in the above-described first embodiment, the resonant frequency of the antenna changes depending on the length of the first element 21 and the sensitivity at high frequencies changes depending on the length of the second element 24, so the antenna characteristics can be tuned easily.

In the first, the tenth, and the eleventh embodiments, three examples have been described in which the position where the first element 21 extends from the feed terminal 4 differs from one another, but the position where the first element 21 extends from the feed terminal 4 may be anywhere on the top end of the feed terminal 4 regardless of the descriptions in these embodiments.

In the tenth and the eleventh embodiments, the variations of the position where the first element 21 extending upward from the feed terminal 4 extends from the feed terminal 4 have been described. Similarly, the position where the second element 24 extends downward from the feed terminal 4 may be anywhere on the bottom end of the feed terminal 4.

Both of the position where the first element 21 extends upward from the feed terminal 4 and the position where the second element 24 juts out downward from the feed terminal 4 may be positions other than the right end of the feed terminal 4. In such a case, the position where the first element 21 extends upward from the feed terminal 4 and the position where the second element 24 extends downward from the feed terminal 4 may be the same position (on a single straight line) or different positions.

Furthermore, the position where the first element 21 extends from the feed terminal 3 may be changed, applying the tenth or the eleventh embodiment to the above-described antenna according to any one of the second to the eighth embodiments.

Twelfth Embodiment

Figure 15:
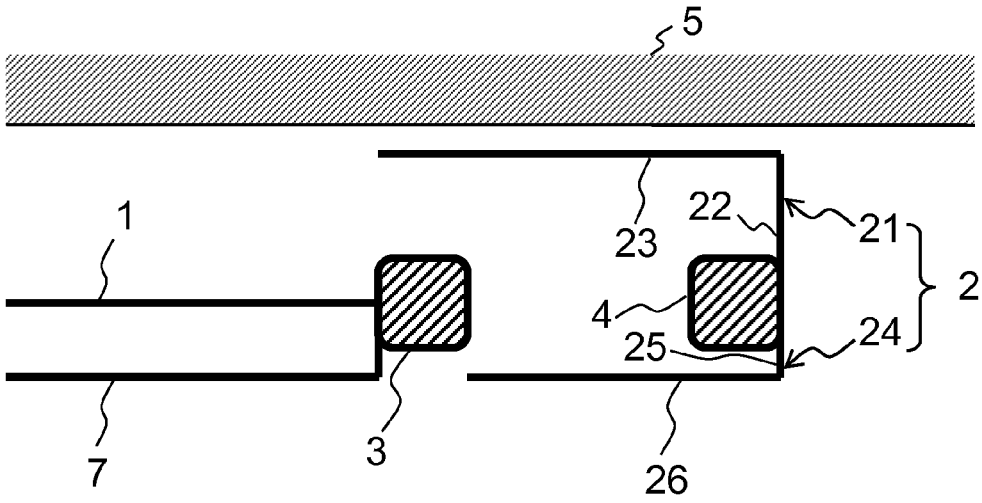
FIG. 15 is an explanatory diagram illustrating a configuration of a glass antenna according to a twelfth embodiment of this invention.

FIG. 15 illustrates a configuration of a glass antenna according to a twelfth embodiment of this invention.

The glass antenna according to the twelfth embodiment comprises a sub core-side element 7 which is parallel to the core-side element 1 of the above-described antenna according to the first embodiment.

The glass antenna according to the twelfth embodiment comprises a core-side element 1 on the feed side, a sub core-side element 7 on the feed side, and a ground-side element 2.

The core-side element 1 extends from the middle of the left end of a feed terminal 3 in the direction away from a feed terminal 4 (leftward). The sub core-side element 7 comprises a vertical part extending downward from the left end of the feed terminal 3 and a horizontal part extending in the direction away from the feed terminal 4 (in other words, leftward in parallel to the core-side element 1) from the lower end of the vertical part.

The ground-side element 2 comprises a first element 21 connected to an upper part of the feed terminal 4 and the second element 24 connected to a lower part thereof.

The first element 21 comprises a vertical part 22 and a horizontal part 23. The horizontal part 23 is connected to the feed terminal 4 via a vertical part 22, which extends upward from the feed terminal 4, and extends from the connection point with the vertical part 22 in the direction of the feed terminal 3 (leftward). The entirety of the first element 21 capacitively couples with the body flange.

The second element 24 comprises a vertical part 25 and a horizontal part 26. The horizontal part 26 is connected to the feed terminal 4 via a vertical part 25, which extends downward from the right end of the feed terminal 4, and extends horizontally from the connection point with the vertical part 25 to the proximity of the feed terminal 3 in the direction of the feed terminal 3 (leftward).

It is preferable that the horizontal part 26 of the second element 24 and the horizontal part of the sub core-side element 7 are located on the same straight line. The locations of the horizontal part 26 and the horizontal part of the sub core-side element 7 are not limited to those shown in the drawing and may be lower (farther than the feed terminals 3 and 4).

According to the antenna of the twelfth embodiment, like in the above-described first embodiment, the resonant frequency of the antenna changes depending on the length of the first element 21 and the sensitivity at high frequencies changes depending on the length of the second element 24, so the antenna characteristics can be tuned easily. Furthermore, the element parallel to the core-side element 1 improves the antenna sensitivity (gain).

The horizontal part 23 and/or the horizontal part 26 may extend rightward, applying any one of the second to the fourth embodiments to the antenna according to the twelfth embodiment.

Thirteenth Embodiment

Figure 16:
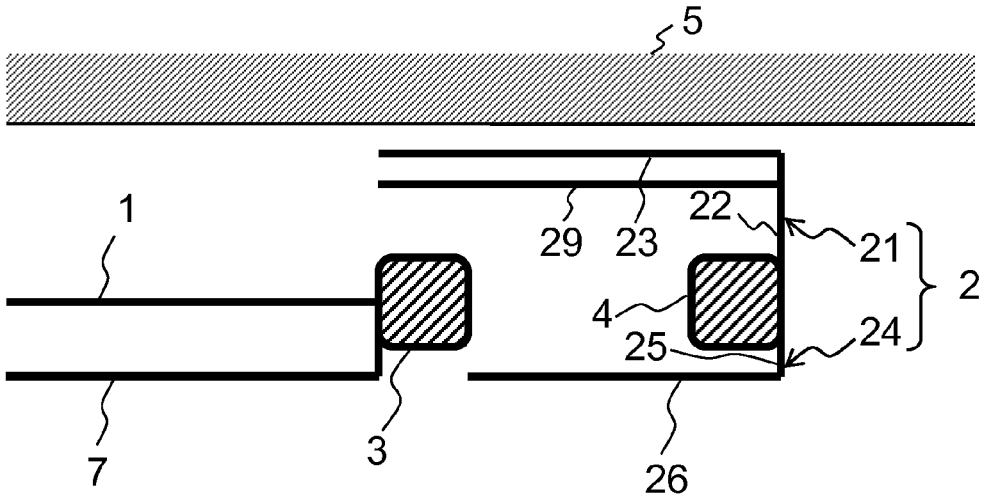
FIG. 16 is an explanatory diagram illustrating a configuration of a glass antenna according to a thirteenth embodiment of this invention.

FIG. 16 illustrates a configuration of a glass antenna according to a thirteenth embodiment of this invention.

The glass antenna according to the thirteenth embodiment is an antenna which includes a plurality of horizontal parts of the first element 21 in the above-described glass antenna according to the twelfth embodiment.

The glass antenna according to the thirteenth embodiment comprises a core-side element 1 on the feed side, a sub core-side element 7 on the feed side, and a ground-side element 2.

The core-side element 1 and the sub core-side element 7 are connected to a feed terminal 3 and they are arranged in parallel. The core-side element 1 extends in the direction away from a feed terminal 4 (leftward) from the middle of the left end of the feed terminal 3. The sub core-side element 1 comprises a vertical part extending downward from the left end of the feed terminal 3 and a horizontal part extending in the direction away from the feed terminal 4 (in other words, leftward in parallel to the core-side element 1) from the lower end of the vertical part.

The ground-side element 2 comprises a first element 21 connected to an upper part of the feed terminal 4 and a second element 24 connected to a lower part thereof.

The first element 21 extends upward from the feed terminal 4 to form a vertical part 22. Then, the end of the vertical part 22 bends in the direction of the feed terminal 3 (leftward) and extends to the proximity of the feed terminal 3 to form a horizontal part 23. The first element 21 bifurcates at the middle of the vertical part 22 and extends in the direction of the feed terminal 3 (leftward) to form the horizontal part 29, which is parallel to the horizontal part 23.

The horizontal part 23 is close to the body flange 5 of the vehicle on which this antenna is to be mounted, so the first element 21 capacitively couples with the body flange 5 (the ground). In particular, the horizontal part 23 is arranged in parallel to the body flange and the horizontal part 29 is arranged in parallel to the horizontal part 23, so that the entirety of the horizontal part 23 and the horizontal part 29 capacitively couples with the body flange. In other words, the horizontal part 29 capacitively couples with the body flange via the vertical part 23.

The second element 24 comprises a vertical part 25 and a horizontal part 26. The horizontal part 26 is connected to the feed terminal 4 via the vertical part 25, which extends downward from the feed terminal 4, and extends horizontally from the connection point with the vertical part 25 to the proximity of the feed terminal 3 in the direction of the feed terminal 3 (leftward).

It is preferable that the horizontal part 26 of the second element 24 and the horizontal part of the sub core-side element 7 be on the same straight line. The locations of the horizontal part 26 and the horizontal part of the sub core-side element 7 are not limited to those shown in the drawing and may be lower (farther than the feed terminal 3 and 4).

According to the antenna of the thirteenth embodiment, the additional element parallel to the core-side element 1 is provided to improve the antenna sensitivity (gain). Furthermore, the strength of the capacitive coupling between the first element 21 and the body flange can be changed by adjusting the lengths of the horizontal parts 23 and 29, so that the resonant frequency of the antenna can be changed.

The horizontal part 23 and/or the horizontal part 26 may extend rightward, applying any one of the second to the fourth embodiment to the antenna according to the thirteenth embodiment.

Fourteenth Embodiment

Figure 17:
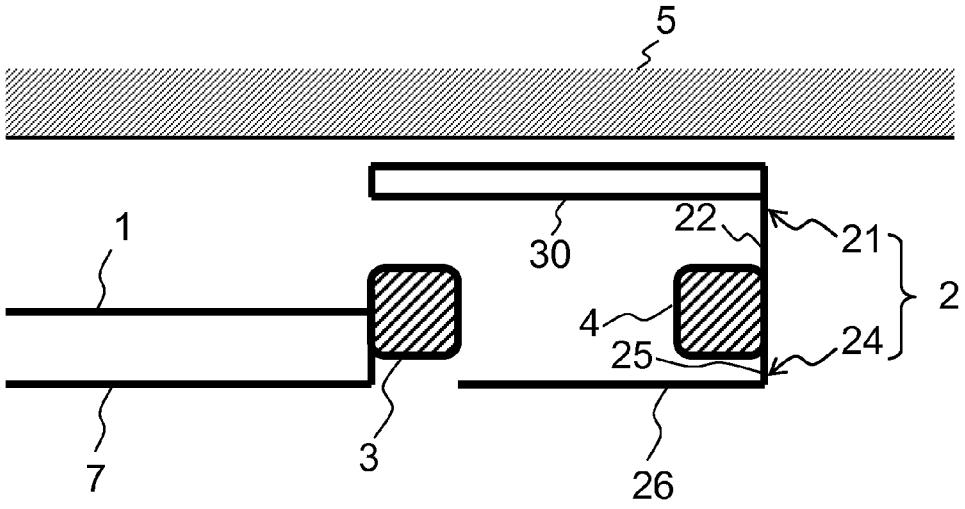
FIG. 17 is an explanatory diagram illustrating a configuration of a glass antenna according to a fourteenth embodiment of this invention.

FIG. 17 illustrates a configuration of a glass antenna according to a fourteenth embodiment of this invention.

In the glass antenna according to the fourteenth embodiment, the horizontal part of the first element 21 in the above-described glass antenna according to the twelfth embodiment is loop-shaped.

The glass antenna according to the fourteenth embodiment comprises a core-side element 1 on the feed side, a sub core-side element 7 on the feed side, and a ground-side element 2.

The core-side element 1 and the sub core-side element 7 are connected to a feed terminal 3 and they are arranged in parallel to each other. The core-side element 1 extends from the middle of the left end of the feed terminal 3 in the direction away from a feed terminal 4 (leftward). The sub core-side element 7 comprises a vertical part extending downward from the left end of the feed terminal 3 and a horizontal part extending from the lower end of the vertical part in the direction away from the feed terminal 4 (in other words, leftward in parallel to the core-side element 1).

The ground-side element 2 comprises a first element 21 connected to an upper part of the feed terminal 4 and the second element 24 connected to a lower part thereof.

The first element 21 extends upward from the feed terminal 4 to form a vertical part 22. Furthermore, it includes a loop conductor 30 at the end of the vertical part 22. The end of the loop conductor 30 extends to the proximity of the feed terminal 3.

The loop conductor 30 is close to the body flange 5 of the vehicle on which this antenna is to be mounted, so the first element 21 capacitively couples with the body flange 5 (the ground). In particular, the upper line of the loop conductor 30 is arranged in parallel to the body flange, so that the entire upper line of the loop conductor 30 capacitively couples with the body flange.

The second element 24 comprises a vertical part 25 and a horizontal part 26. The horizontal part 26 is connected to the feed terminal 4 via the vertical part 25, which extends downward from the feed terminal 4, and extends horizontally from the connection point with the vertical part 25 to the proximity of the feed terminal 3 in the direction of the feed terminal 3 (leftward).

It is preferable that the horizontal part 26 of the second element 24 and the horizontal part of the sub core-side element 7 be located on the same straight line. The locations of the horizontal part 26 and the horizontal part of the sub core-side element 7 are not limited to those shown in the drawing and may be lower (farther than the feed terminal 3 and 4).

According to the antenna of the fourteenth embodiment, the additional element parallel to the core-side element 1 is provided to improve the antenna sensitivity (gain). Besides, since the loop conductor 30 is provided at the end of the first element 21, a broader band for the antenna can be attained and the resonant frequency of the antenna can be changed easily.

The horizontal part 26 may extend rightward, applying the third embodiment to the antenna according to the fourteenth embodiment.

Fifteenth Embodiment

Figure 18:
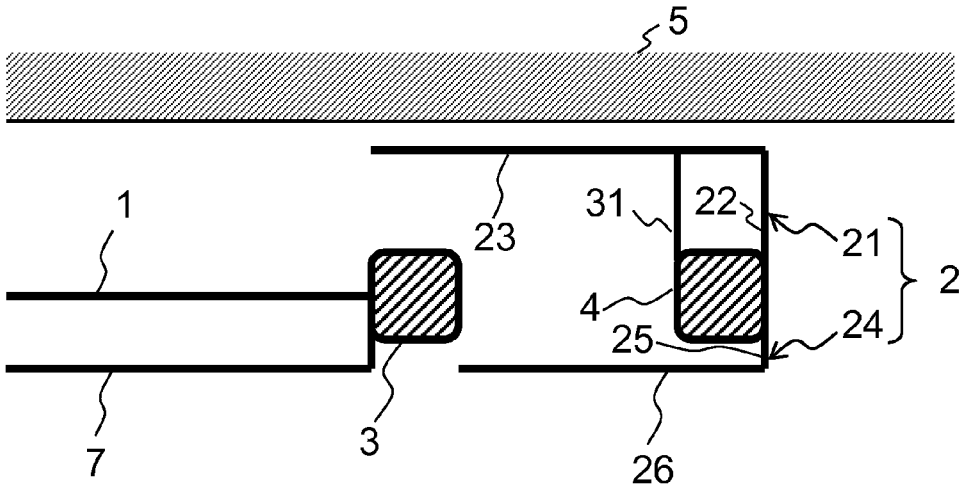
FIG. 18 is an explanatory diagram illustrating a configuration of a glass antenna according to a fifteenth embodiment of this invention.

FIG. 18 illustrates a configuration of a glass antenna according to a fifteenth embodiment of this invention.

The glass antenna according to the fifteenth embodiment is an antenna which includes two vertical parts 22 and 31 in the above-described antenna according to the twelfth embodiment.

The glass antenna according to the fifteenth embodiment comprises a core-side element 1 on the feed side, a sub core-side element 7 on the feed side, and a ground-side element 2.

The core-side element 1 and the sub core-side element 7 are connected to a feed terminal 3 and they are arranged in parallel to each other. The core-side element 1 extends from the middle of the left end of the feed terminal 3 in the direction away from a feed terminal 4 (leftward). The sub core-side element 7 comprises a vertical part extending downward from the left end of the feed terminal 3 and a horizontal part extending from the lower end of the vertical part in the direction away from the feed terminal 4 (in other words, leftward in parallel to the core-side element 1).

The ground-side element 2 comprises a first element 21 connected to an upper part of the feed terminal 4 and the second element 24 connected to a lower part thereof.

The first element 21 is comprised of a vertical part 22, a vertical part 31, and a horizontal part 23. The vertical part 22 extends upward from the right end of the feed terminal 4 and the vertical part 31 extends upward from the left end of the feed terminal 4. The horizontal part 23 is connected to the feed terminal 4 via the vertical parts 22 and 31 and extends from the connection point with the vertical part 22 in the direction of the feed terminal 3 (leftward), so that the entirety of the first element 21 capacitively couples with the body flange.

The top end of the vertical part 31 is connected to the middle of the horizontal part 23. Namely, in the first element 21, the feed terminal 4, the vertical part 22, the horizontal part 23, and the vertical part 31 form a loop.

The positions where the vertical parts 22 and 31 extends from the feed terminal 3 are not limited to those shown in the drawing and may be anywhere on the top end of the feed terminal 4.

The second element 24 is comprised of a vertical part 25 and a horizontal part 26. The horizontal part 26 is connected to the feed terminal 4 via the vertical part 25, which extends downward from the right end of the feed terminal 4, and extends horizontally from the connection point with the vertical part 25 to the proximity of the feed terminal 3 in the direction of the feed terminal 3 (leftward).

It is preferable that the horizontal part 26 of the second element 24 and the horizontal part of the sub core-side element 7 be located on the same straight line. The locations of the horizontal part 26 and the horizontal part of the sub core-side element 7 are not limited to those shown in the drawing and may be lower (farther than the feed terminal 3 and 4).

According to the antenna of the fifteenth embodiment, the additional element parallel to the core-side element 1 is provided to improve the antenna sensitivity (gain). Besides, since a loop is formed by the vertical part 22, the vertical part 31, and the horizontal part 23, a broader band for the antenna can be attained and the resonant frequency of the antenna can be changed easily.

The horizontal part 23 and/or the horizontal part 26 may extend rightward, applying any one of the second to the fourth embodiments to the antenna according to the fifteenth embodiment.

Antenna Characteristics

Figure 19:
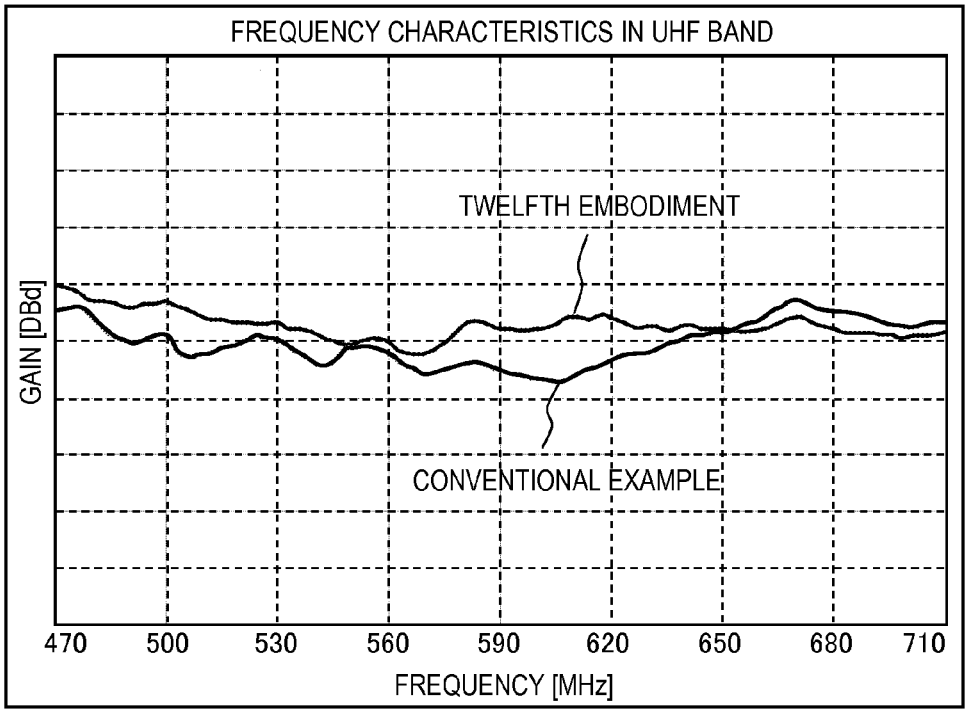
FIG. 19 is an explanatory diagram illustrating the characteristics of the glass antenna according to the twelfth embodiment of this invention.

FIG. 19 illustrates the characteristics of the glass antenna according to the twelfth embodiment of this invention.

Figure 20:
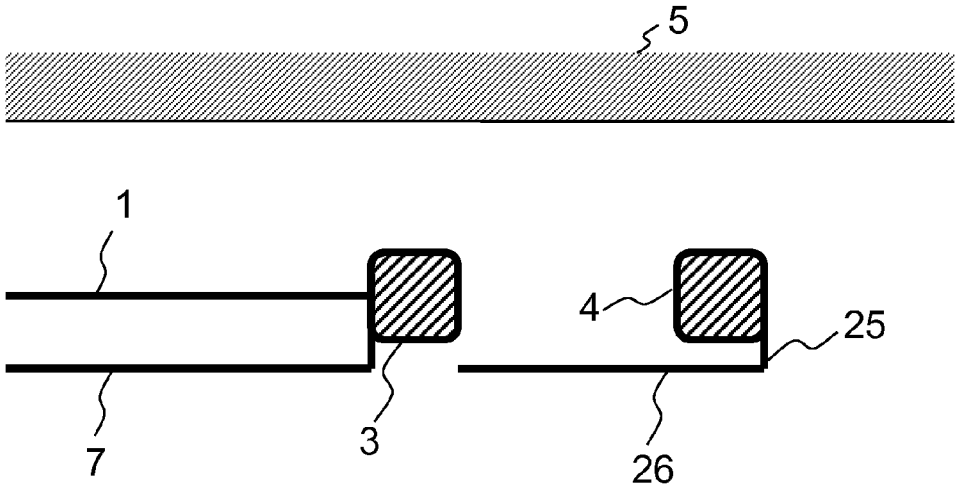
PRIOR ART Fig. 20
FIG. 20 is an explanatory diagram illustrating a configuration of comparative example of a glass antenna.

FIG. 19 also shows the characteristics of a conventional antenna shown in FIG. 20 in addition to the characteristics of the glass antenna according to the twelfth embodiment.

The conventional antenna shown in FIG. 20 comprises a core-side element 1 on the feed side, a sub core-side element 7 on the feed side, and a ground-side element 2. The core-side element 1 extends leftward from the middle of the left end of the feed terminal 3. The sub core-side element 7 extends downward from the left end of the feed terminal 3 and then extends leftward in parallel to the core-side element 1. The ground-side element 2 is comprised of a vertical part 25 and a horizontal part 26. The horizontal part 26 is connected to the feed terminal 4 via the vertical part, which extends downward from the feed terminal 4, and extends horizontally leftward to the proximity of the feed terminal 3.

Since the antenna according to the embodiments of this invention comprises the first element 21 located close to the body flange 5 and capacitively coupling with the ground, the antenna sensitivity (gain) improves as shown in FIG. 19.

Hereinabove, preferred embodiments of this invention have been described on antennas for digital territorial broadcast signals in Japan (470 to 710 MHz) and UHF TV broadcast signals by way of example. This invention may be applied to antennas for other frequency bands, for example, the UHF digital terrestrial broadcast signals in European countries (470 to 862 MHz) or the VHF digital terrestrial broadcast signals in European countries (174 to 862 MHz).

Figure 12:
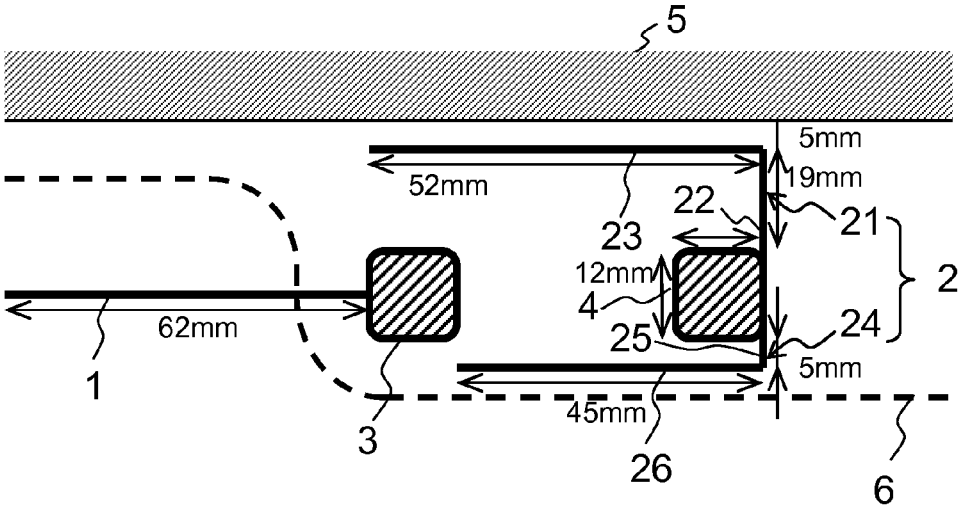
FIG. 12 is an explanatory diagram illustrating a modified example in which the antenna according to the first embodiment of this invention has been tuned to another frequency.

FIG. 12 shows a modified example in which the antenna according to the first embodiment of this invention has been tuned to the 470 to 862 MHz. Compared with the above-described antenna according to the first embodiment (FIG. 1), the antenna in FIG. 12 has shorter horizontal elements (a core-side element 1, a horizontal part 23 of a first element 21, and a horizontal part 26 of a second element 24) in length by approximately 12%. This is because the central frequency of the European UHF digital terrestrial broadcast signals is approximately 12% higher than the central frequency of Japanese digital terrestrial broadcast signals.

If the central frequency is lower like the North American area, as the UHF broadcast frequency range is 470 MHz to 698 MHz, it is appropriate that horizontal elements be longer in accordance with the rate of the central frequency.

Although the preferred embodiments of this invention have been described on glass antennas for vehicles, this invention is applicable to any other types of antennas as far as the antenna is configured with a pattern formed on an insulating or dielectric material. For example, there is an antenna provided by bonding a synthetic resin sheet with a pattern thereon to glass.

Although the antennas according to the above-described preferred embodiments are horizontally-polarized antennas for receiving television broadcast signals, they may be rotated clockwise (or counterclockwise) by 90 degrees to provide vertically-polarized antennas for other mobile communications.

What is claimed is:

1. An antenna, comprising:

a core-side element connected to a core-side feed point; and a ground-side element for receiving a radio wave of the same frequency band as the core-side element, the ground side element being connected to a ground-side feed point, wherein the core-side element extends from the core-side feed point in a predetermined direction;

wherein the ground-side element includes:

a first element which is connected to the ground-side feed point and extends in parallel to the core-side element; and a second element which is connected to the ground-side feed point and extends in parallel to the first element;

wherein the first element is arranged close to a body flange to capacitively couple with the body flange;

wherein the core-side feed point is connected to a receiver; and wherein the ground-side feed point is connected to said receiver.

2. The antenna according to claim 1, wherein the core-side element includes at least one line extending from the core-side feed point in a horizontal direction.

3. The antenna according to claim 2, wherein the first element extends in parallel to the core-side element via a first conductive part extending from the ground-side feed point in a first vertical direction; and wherein the second element extends in parallel to the first element via a second conductive part extending from the ground-side feed point in a second vertical direction opposite from the first vertical direction.

4. The antenna according to claim 3, wherein at least a part of the first and second elements, the first and second conductive parts, the core-side feed point and the ground-side feed point of the antenna are arranged on a ceramic paste layer provided on an interior surface of a rim of a window glass; and wherein at least a part of the first and second elements, the first and second conductive parts, the core-side feed point and the ground-side feed point are masked with a resin cover.

5. The antenna according to claim 1, wherein the first element and the second element extend in the direction in which the core-side element extends.

6. The antenna according to claim 1, wherein at least one of the first element and the second element includes an auxiliary element which extends in a direction opposite from the direction in which the first element and the second element extend.

7. A diversity antenna comprising a pair of the antennas according to claim 1 placed side by side.

8. An antenna, comprising:

a core-side element connected to a core-side feed point; and a ground-side element connected to a ground-side feed point, wherein the core-side element extends from the core-side feed point in a predetermined direction;

wherein the ground-side element includes:

a first element which is connected to the ground-side feed point and extends in parallel to the core-side element; and a second element which is connected to the ground-side feed point and extends in parallel to the first element;

wherein the first element is arranged close to a body flange to capacitively couple with the body flange;

wherein the core-side feed point is connected to a receiver;

wherein the ground-side feed point is connected to said receiver;

wherein the core-side feed point and the ground-side feed point are at least partially at a same vertical position;

wherein at least a portion of the core-side feed point is disposed below at least a portion of the first element and above at least a portion of the second element; and wherein the first element and the second element extend from the ground-side feed point towards the core-side feed point.

9. The antenna according to claim 8, wherein the core-side element includes at least one line extending from the core-side feed point in a horizontal direction.

10. The antenna according to claim 9, wherein the first element extends in parallel to the core-side element via a first conductive part extending from the ground-side feed point in a first vertical direction; and wherein the second element extends in parallel to the first element via a second conductive part extending from the ground-side feed point in a second vertical direction opposite from the first vertical direction.

11. The antenna according to claim 10, wherein at least a part of the first and second elements, the first and second conductive parts, the core-side feed point and the ground-side feed point of the antenna are arranged on a ceramic paste layer provided on an interior surface of a rim of a window glass; and wherein at least a part of the first and second elements, the first and second conductive parts, the core-side feed point and the ground-side feed point are masked with a resin cover.

12. The antenna according to claim 8, wherein the first element and the second element extend in the direction in which the core-side element extends.

13. The antenna according to claim 8, wherein at least one of the first element and the second element includes an auxiliary element which extends in a direction opposite from the direction in which the first element and the second element extend.

14. A diversity antenna comprising a pair of the antennas according to claim 8 placed side by side.

* * * * *